United States Patent [19]

Tippmann

[11] Patent Number: 4,819,609

[45] Date of Patent: Apr. 11, 1989

[54] AUTOMATIC FEED MARKING PELLET GUN

[76] Inventor: Dennis J. Tippmann, 12708 Parent Rd., New Haven, Ind. 46774

[21] Appl. No.: 944,222

[22] Filed: Dec. 22, 1986

[51] Int. Cl.[4] ..... F41B 11/02; F41B 11/00; F41C 25/00

[52] U.S. Cl. ..... 124/72; 124/48; 124/66; 124/75

[58] Field of Search ..... 124/71, 72, 73, 74, 124/75, 76, 77, 52, 51 R, 59, 48, 67; 42/19; 89/33.02, 142

[56] References Cited

U.S. PATENT DOCUMENTS

| | | | |
|---|---|---|---|
| 2,432,486 | 12/1947 | Patchett | 89/142 |
| 2,619,949 | 12/1952 | Rock | 124/52 |
| 2,699,767 | 1/1955 | Mangolini | 124/75 |
| 3,000,371 | 9/1961 | Hyde | 124/75 |
| 3,204,625 | 9/1965 | Shepherd | 124/74 |
| 3,695,246 | 10/1972 | Filippi et al. | 124/77 |
| 3,773,026 | 11/1973 | Romero | 124/48 |
| 3,951,038 | 4/1976 | Van Langenhoven | 124/67 |
| 4,004,566 | 1/1977 | Fischer | 124/59 |
| 4,038,961 | 8/1977 | Olofsson | 124/76 |
| 4,116,193 | 9/1978 | Chiba | 124/72 |
| 4,531,503 | 7/1985 | Shephard | 124/76 |

FOREIGN PATENT DOCUMENTS

| | | | |
|---|---|---|---|
| 0108955 | 2/1925 | Switzerland | 89/33.02 |

*Primary Examiner*—Richard J. Johnson

*Assistant Examiner*—Michael Brown

*Attorney, Agent, or Firm*—Roger M. Rickert

[57] ABSTRACT

A compressed gas powered marking gun for firing marking pellets and similar projectiles each of which is generally spherical and sufficiently fragile so as to break upon impact with a target is disclosed including a compressed gas source, a projectile supply magazine containing a plurality of projectiles, and means for sequentially aligning projectiles from the supply magazine with the gun barrel through which projectiles may be sequentially discharged. The firing mechanism includes a user actuable trigger for selectively supplying compressed gas from the source to expel a projectile through the barrel, and a selector mechanism movable between a first position where the trigger actuated supplying of gas is disabled, a second position where one actuation of the trigger supplies gas to expel a single projectile, and a third position where compressed gas is repeatedly periodically supplied. The gun includes an improved mechanism for releasing gas to propel a projectile along a gun barrel and from the gun comprising a shuttle valve movable between predetermined limits along a line generally collinear with the gun barrel, a spring biased striker for selectively impacting one shuttle valve end, a user actuable trigger mechanism for releasing the striker to move under the spring bias and impact the shuttle valve one end, a first valve near the shuttle valve one end opened by striker impact to release gas and a second valve near the shuttle valve end opposite said one end.

21 Claims, 5 Drawing Sheets

AUTOMATIC FEED MARKING PELLET GUN

SUMMARY OF THE INVENTION

The present invention relates generally to compressed gas powered guns and more particularly to such guns for firing relatively fragile projectiles such as tranquilizer darts or marking pellets. More specifically, the present invention provides such a fragile projectile, gas powered gun operable in either a semi-automatic or a fully automatic mode.

In general, a semi-automatic weapon is one which fires one cartridge each time the trigger is pulled and moves another cartridge into position to be fired the next time the trigger is pulled. Such weapons are sometimes referred to as "self Loading." A fully automatic weapon, on the other hand, has such a self loading feature, but continues to fire cartridge after cartridge so long as the trigger is held down. A number of conventional weapons include selector switches for changing the mode of operation between semi-automatic and fully automatic.

A variety of guns for firing relatively fragile projectiles are also known including tranquilizer guns and marking (commonly called paint ball) guns. Tranquilizer guns use a compressed gas to fire a chemically treated dart and are frequently used by veterinarians or wildlife management personnel to temporarily disable an animal without harming the animal. Marking guns use compressed gas pressure to fire a gelatinous capsule containing a marking material. The capsule breaks on impact with a target dispersing the material to mark the target where hit by the capsule. A recent popular recreational use for marking guns is in the "Survival Game", a kind of mock war where opposing sides attempt to seek out and "kill" one another by marking the opposition with a paint ball. Marking guns have also been used to segregate cattle within a herd and for a variety of other marking purposes. Due to the fragile nature of the projectile, these guns typically hold only one projectile at a time and require manual reloading after each shot. Some marking guns have been designed to hold more than one projectile, but still require some type of manual loading operation and fail to provide a self-loading feature.

Among the several objects of the present invention may be noted the provision of a compressed gas powered gun for firing relatively fragile projectiles having a self-loading feature; the provision of a marking gun operable in either semi-automatic or fully automatic modes; the provision of an improved packaging and loading clip for fragile projectiles; the provision of a unique valving arrangement for releasing compressed gas to fire a projectile; and the provision of an improved projectile feed mechanism for a gas powered gun. These as well as other objects and advantageous features of the present invention will be in part apparent and in part pointed out hereinafter.

In general, a compressed gas powered gun for discharging projectiles and, upon the discharge of one projectile, to automatically position another projectile in a location within the gun to be subsequently discharged therefrom includes a compressed gas source, a projectile supply magazine containing a plurality of projectiles, each projectile having a generally circular cross-sectional configuration, and a barrel through which projectiles may be sequentially discharged. The firing mechanism includes a user actuable trigger, a spring loaded slide which is released to move under spring urging upon user actuation of the trigger, and a valve assembly actuable by slide impact to release compressed gas thereby selectively supplying compressed gas from the source to expel a projectile through the barrel. The slide and valve assembly is axially aligned with the barrel. The projectile feed mechanism for sequentially aligning projectiles from the supply magazine with the barrel includes at least one projectile containing clip formed as a rigid open-ended hollow cylinder having an inside diameter substantially the same as the circular cross-section diameter of the projectile.

Also in general and in one form of the invention, a compressed gas powered marking gun for firing marking pellets each of which is generally spherical and sufficiently fragile so as to break upon impact with a target has a multiple marking pellet clip arrangement for receiving and protecting pellets both prior to loading the pellets into the gun and during feeding of the pellets to a firing location within the gun comprising a plurality of rigid open-ended hollow cylinders, each having an inside diameter substantially the same as the circular cross-section diameter of the pellet for receiving a pellet. A plurality of these projectile receiving cylinders or clips are flexibly joined together with their respective cylindrical axes parallel to form the clip arrangement.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
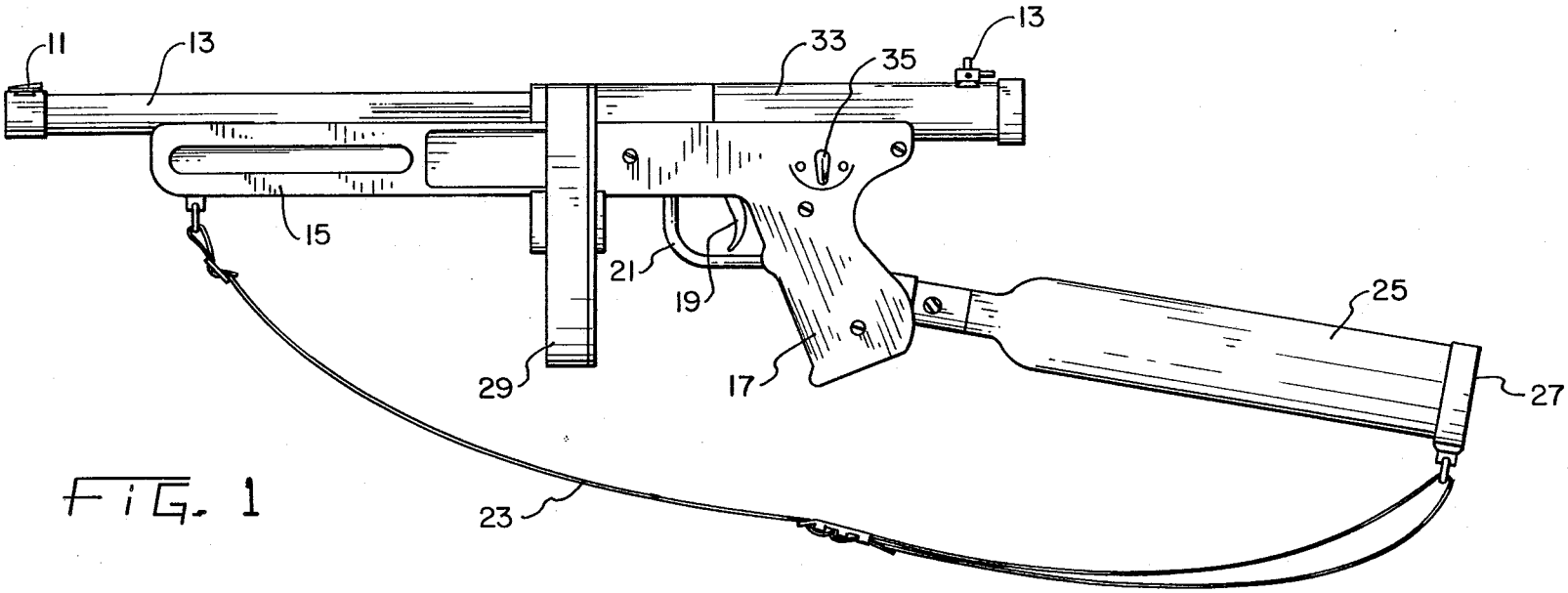
FIG. 1 is a side elevation view of a gas powered gun incorporating the present invention in one form.

Referring first to FIG. 1, many aspects of the gun are either conventional or are named by analogy with conventional parts of conventional firearms. The gun includes a front sight 11, a pivotable rear sight 13 selectively providing either a peep sight or an open notch sight, a front handgrip or forestock 15, a pistolgrip 17, a trigger 19, a trigger guard 21, a sling 23, a shoulder stock 25 and buttplate 27. A generally circular drum magazine 29 is located between the barrel 31 and receiver 33. Shoulder stock 25 is hollow and cylindrical in shape, being formed from a $CO_2$ container. Trigger guard 21 also functions as a supply tube for conveying the compressed gas from the container to the appropriate region within receiver 33. A selector switch 35 movable between safe, semi-automatic, and fully automatic mode settings is also illustrated.

Figure 2:
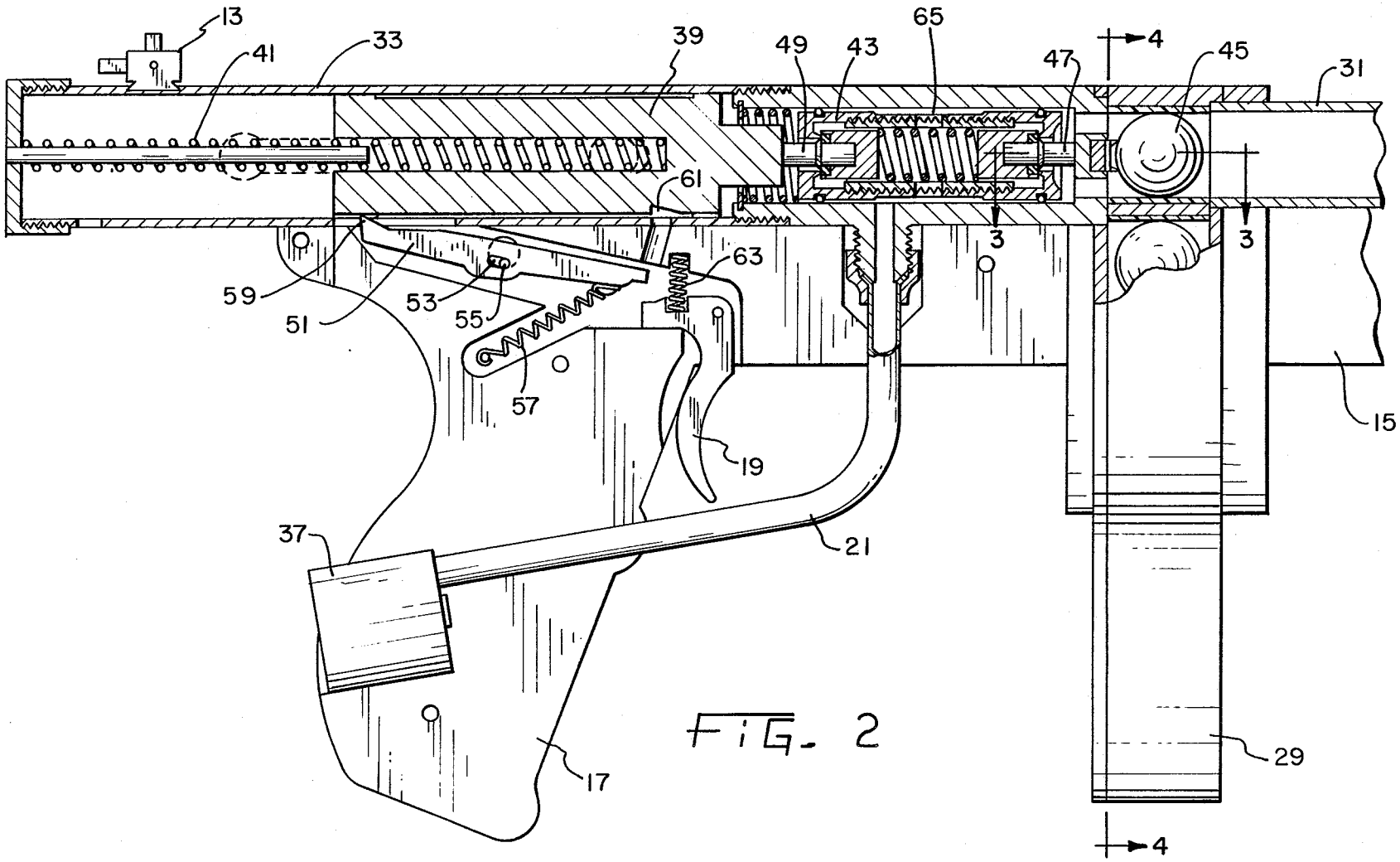
FIG. 2 is a cross-sectional view of a portion of the gun from the side opposite that shown in FIG. 1.

FIG. 2 is a view from the side opposite that shown in FIG. 1. In FIG. 2, the $CO_2$ canister or other compressed gas source has been unscrewed from the internally threaded fitting 37 of conventional valve opening design. The internal mechanism is seen to include, in addition to a user actuable trigger 19, a spring loaded slide or striker 39 which is released to move under the urging of coil spring 41 upon user actuation of the trigger 19, and a valve assembly 43 (better seen in FIG. 5) actuable by slide impact to release compressed gas thereby selectively supplying compressed gas from the source 25 to expel a projectile 45 through the barrel 31. The slide 39, projectile 45 and valve assembly 43 are axially aligned with the barrel 31. Valve assembly 43 is movable along this common axis within predetermined limits and includes one valve near each end thereof. One of these valves 49 opens when impacted by the slide 39 to provide blow-back gas pressure for returning the slide against spring bias to a retracted position (FIG. 8*a*) preparatory to discharging a subsequent projectile. The valve assembly 43 moves toward the barrel 31 in response to slide impact and further aided by blow-back gas pressure. This forward valve assembly movement causes the other of said valves 47 to open supplying the compressed gas from the source to expel the projectile 45.

A pivotable lever or sear 51 is interposed between trigger 19 and slide 39. This lever 51 has a slightly elongated hole 53 which receives pivot pin 55. The elongated hole 53 allows sear 51 to migrate along pivot pin 55 and slip past the end of trigger 19 (compare FIGS. 8*b* and 8*c*) so that only one projectile is fired for each pull of the trigger when in the semi-automatic mode. Sear 51 is biased by spring 57 in a counterclockwise direction about pin 55 as viewed in FIG. 2 so that sear end 59 catches a corresponding notch 61 in the slide 39 holding the slide in its rearward or cocked position ready to fire. Movement of the selector switch 35 of FIG. 1 moves the pivot pin 55 between positions where movement of trigger 19 is ineffective to trip the sear (safe), effective to trip the sear only once until the trigger is released (semi-automatic), and effective to hold the sear out of notch 61 so long as the trigger is held back against the bias of trigger spring 63 (fully automatic).

Figure 7:
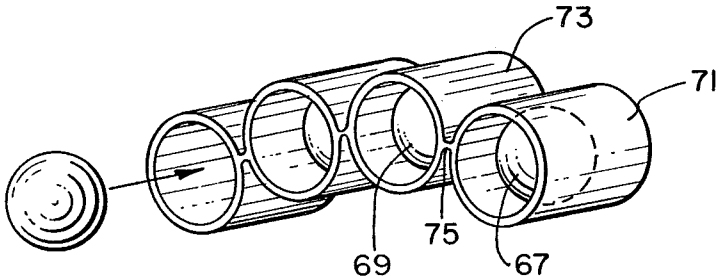
FIG. 7 is a perspective view of a clip arrangement for storing, loading and feeding spherical projectiles to the gun of FIG. 1.

To prepare the gun of FIG. 2 for operation, the compressed gas source 25 must be screwed into fitting 37 thereby opening the source valve and supplying gas by way of the hollow trigger guard 21 to the annular region 65 surrounding valve assembly 43. Projectiles must also be loaded into the magazine 29. In FIG. 7, a multiple marking pellet clip arrangement for receiving and protecting pellets such as 67 and 69 both prior to loading the pellets into the gun and during feeding of the pellets to a firing location within the gun is seen to include a plurality of rigid open-ended hollow cylinders such as 71 and 73, each having an inside diameter substantially the same as the circular cross-section diameter of the pellet for receiving a pellet. A plurality of these projectile receiving cylinders may be flexibly joined together as by rib 75 with their respective cylindrical axes parallel. The cylinders may be metalic with a web or articulated joint between them or may be injection molded of a material sufficiently flexible to bend and compensate for movement of the clip assembly along the spiral and the correlative change of radius of curvature. If injection molded, the material and cylinder sidewall thickness should be sufficient to protect the fragile pellets from damage during handling as well as during loading or feeding within the gun. While separated clips may be used, a convenient number, such as four, joined together facilitates loading. It is also possible to have the pellets in individual separated cylindrical clips and to load the magazine one such cylinder at a time.

The magazine 29 receives, in a generally spiral pattern, a plurality of the projectile containing clips with their respective cylindrical axes parallel. The magazine contains a generally constant force coil spring 77, one end of which is fixed to the magazine at 79, for urging projectile containing clips from the magazine. The constant force spring comprises a coiled strip of generally flat spring material which moves along a spiral pattern within the magazine, unrolling as clips are introduced into the magazine. A clip latch or escape lever 81, best seen in FIG. 3, has a tip portion 83 which engages a clip cylindrical sidewall for holding a clip in alignment with the barrel against the urging of the constant force spring 77. The clip latch releases (rotates counterclockwise as viewed about the pivot pin 85) in response to gas pressure between the projectile 45 and the forward face of the latch as a projectile is propelled from its clip and along the barrel. This allows the constant force spring 77 to eject the clip and position a next projectile containing clip from the magazine into position in alignment with the barrel.

Figure 3:
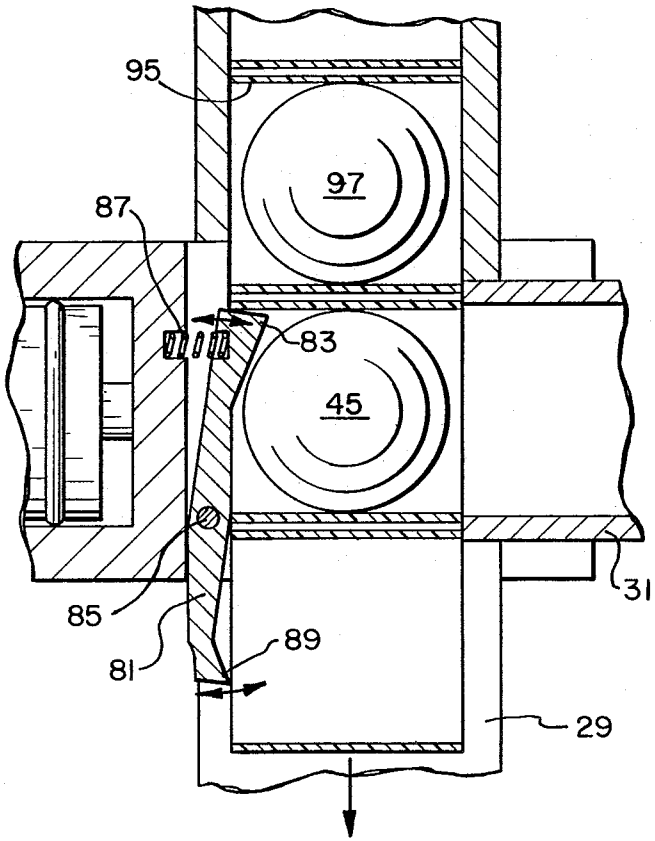
FIG. 3 is a view in cross-section along line 3—3 of FIG. 2.
Figure 4:
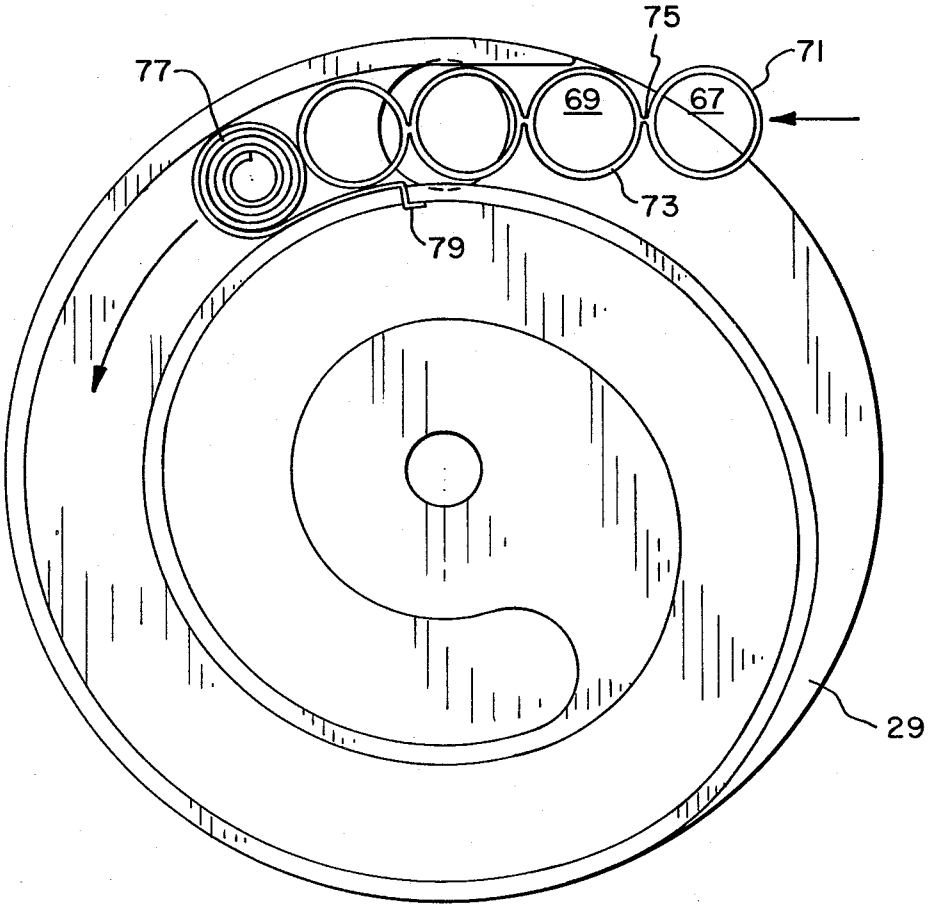
FIG. 4 is a view in cross-section along line 4—4 of FIG. 2.

The clip latch comprises a pivotable arm the tip 83 end of which, when in the position illustrated in FIG. 3, engages a clip to hold that clip in alignment with the barrel. The arm pivots to a second position against the bias of spring 87, releasing the clip in response to said gas pressure. The arm has another end or tip 89 which, when the arm is in the second position, lies in the path of ejected clips, so that, when a clip is ejected, the clip strikes the arm tip 89 returning the arm with the aid of spring 87 to the position shown in FIG. 3.

Figure 5:
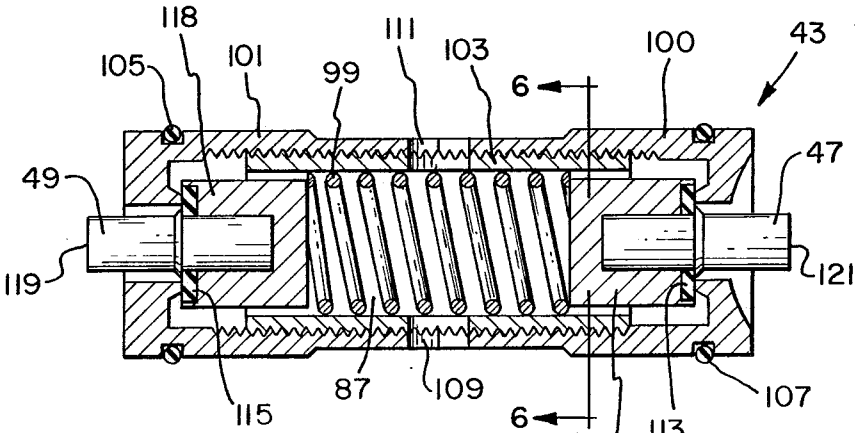
FIG. 5 is a cross-sectional view of the valve assembly shown in FIG. 2.
Figure 6:
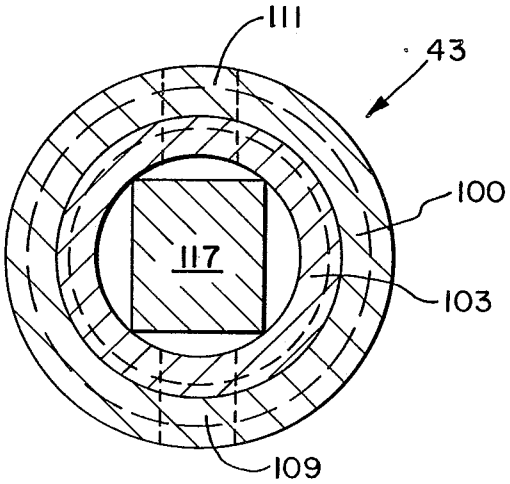
FIG. 6 is a view in cross-section along line 6—6 of FIG. 5.

The details of the shuttling valve assembly 43 are most easily seen in FIGS. 5 and 6. The body of the valve assembly is formed of a pair of internally threaded sleves 100 and 101 screwed onto opposite ends of externally threaded sleeve 103. Valves 47 and 49 have exposed ends 121 and 119 which are axially depressed against the bias of spring 99 to open the valves. Each valve has a gasket or seal 113 and 115 supported at one end of a square valve body 117 and 118. This square configuration as seen in FIG. 6, maintains valve alignment while allowing gas to pass around the body through the four open segments. A pair of diametrically opposed holes 109 and 111 allow gas to pass from the annular region 65 to the valve interior 87. The annular region 65 is in turn sealed by O-rings 105 and 107 which ride against the interior of the receiver.

Once the compressed gas source is attached, the magazine loaded and a projectile aligned with the barrel, and the slide or bolt 39 manually retracted with sear 51 engaging notch 61, the gun is ready to fire projectile after projectile in semi-automatic or fully automatic mode depending on the position of selector switch 35 and therefore also the location of pivot pin 55. The sequence of events during firing of one projectile is most easily understood from the sequential illustrations of FIGS. 8*a*–8*c*.

Figure 8C:
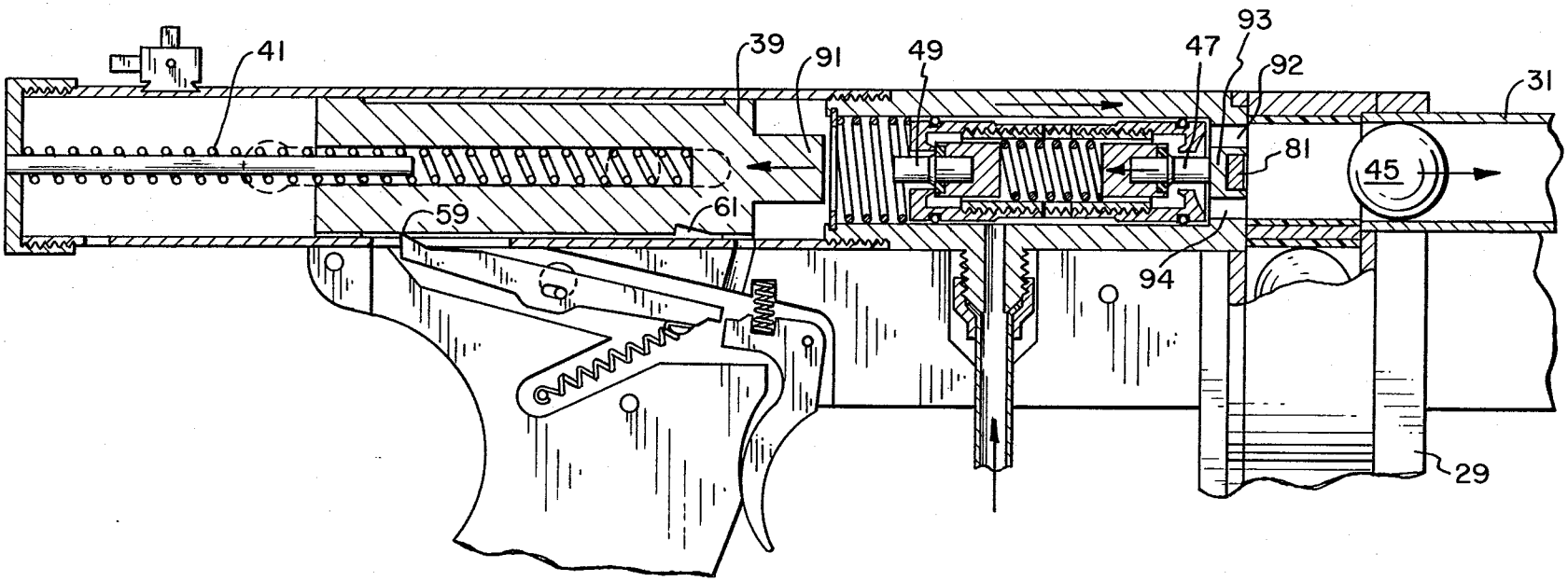
FIGS. 8*a*–8*c* are views similar to FIG. 2, but illustrating sequential operation of the firing mechanism.
Figure 8A:
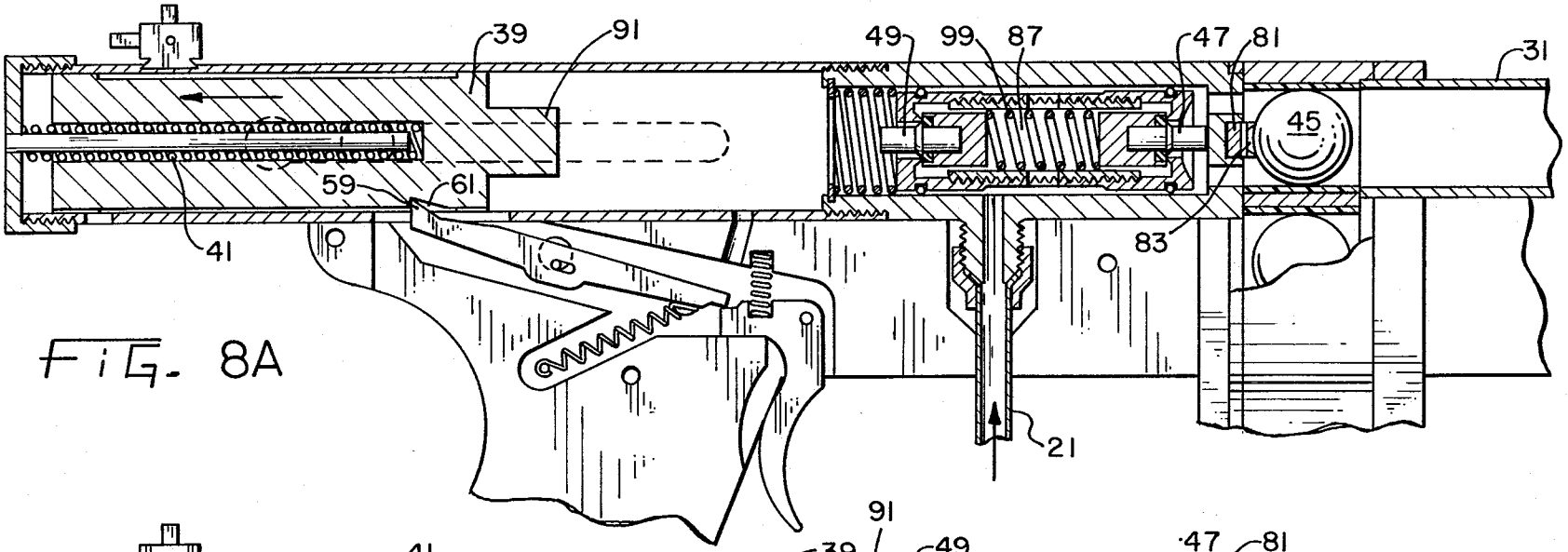

FIG. 8*a* shows the gun in the cocked and ready to fire configuration. Bolt 39 is held retracted against the urging of spring 41 by the tip 59 of the sear in notch 61. The shuttle valve 43 is in a neutral position with both valves 47 and 49 closed and with $CO_2$ under pressure occupying the annular space 65 as well as the interior space 87 of the valve assembly.

Figure 8B:
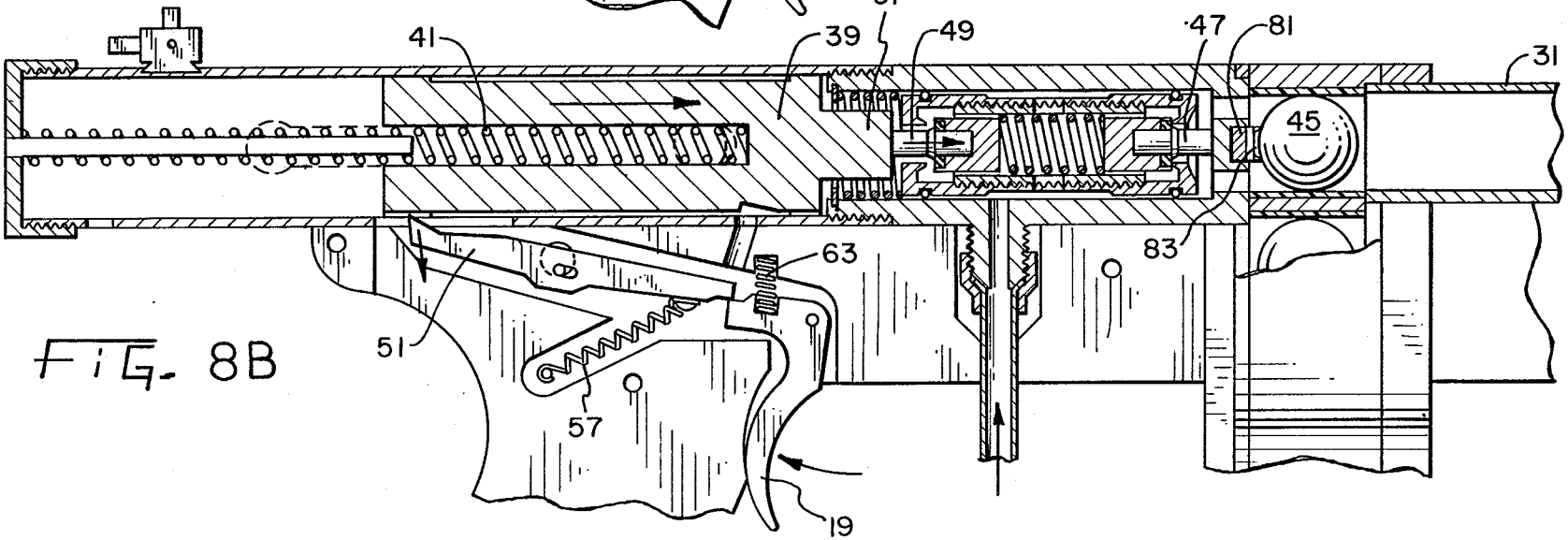

In FIG. 8*b*, the trigger 19 is depressed against the force of spring 63 by the user which pivots sear 51 counterclockwise dislodging sear tip 59 from notch 61 and allowing the bolt or slide 39 to accelerate toward the right. When the end 91 of slide 39 impacts the protruding end of valve 49, that valve opens venting gas toward end 91 providing a blow-back pressure to recock slide 39 and at the same time, this gas pressure forces the shuttle valve 43 toward the right.

In FIG. 8c, this rightward shuttle valve motion results in the exposed end of valve 47 engaging the transverse bar 93 causing valve 47 to open venting gas under pressure around the top 92 and bottom 94 of bar 93 and into the region between projectile 45 and escape lever 81. This gas pressure ejects the projectile out of the barrel and forces the escape lever tip 83 rearwardly allowing the next cylinder 95 and its projectile 97 to come into alignment with the barrel for the next shot. As the gas escapes, spring 99 causes the valves 47 and 49 to re-close preparatory for that next shot.

The magazine 29 may also take a straight or linear form extending laterally from the side of the marking pellet gun providing a handle similar in appearance to a so-called "sten gun." In this form, the clip of FIG. 7 is also straight with all the cylindrical axes in a common plane and the joining web portions need not be flexible. Certain economies of manufacture are achieved with this variation on the magazine configuration.

From the foregoing, it is now apparent that a novel arrangement for packaging, dispensing and firing fragile projectiles has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A compressed gas powered gun for discharging generally spherical projectiles of a type sufficiently fragile so as to break upon impact with a target and, upon the discharge of one projectile, to automatically position another projectile in a location within the gun to be subsequently discharged therefrom comprising:

a compressed gas source comprising a hollow cylindrical canister containing compressed gas, said canister forming the shoulder stock for the gun;

a projectile supply magazine containing a plurality of projectiles, each projectile having a generally circular cross-sectional configuration;

a barrel through which projectiles may be sequentially discharged;

means including a user actuable trigger for selectively supplying compressed gas from the source to expel a projectile through the barrel, the means for selectively supplying compressed gas further including a spring loaded slide which is released to move under spring urging upon user actuation of the trigger, and a valve assembly actuable by slide impact to release gas from the source for propelling a projectile along and out of the barrel; and means for sequentially aligning projectiles from the supply magazine with the barrel including at least one projectile containing clip formed as a rigid open-ended hollow cylinder having an inside diameter substantially the same as the circular cross-section diameter of the projectile.

2. The compressed gas powered gun of claim 1 wherein a number of the projectile containing clips are joined together.

3. The compressed gas powered gun of claim 1 wherein the constant force spring comprises a coiled strip of generally flat spring material which moves along a spiral pattern within the magazine, unrolling as clips are introduced into the magazine.

4. A compressed gas powered gun for discharging projectiles and, upon the discharge of one projectile, to automatically position another projectile in a location within the gun to be subsequently discharged therefrom comprising:

a compressed gas source;

a projectile supply magazine containing a plurality of projectiles, each projectile having a generally circular cross-sectional configuration;

a barrel through which projectiles may be sequentially discharged;

means including a user actuable trigger, a spring loaded slide which is released to move under spring urging upon user actuation of the trigger, and a valve assembly actuable by slide impact to release compressed gas thereby selectively supplying compressed gas from the source to expel a projectile through the barrel, the slide and valve assembly being axially aligned with the barrel, the valve assembly being movable along the common axis and including one valve near each end thereof, one of said valves opening when impacted by the slide to provide blow-back gas pressure for returning the slide against spring bias to a retracted position preparatory to discharging a subsequent projectile; and means for sequentially aligning projectiles from the supply magazine with the barrel.

5. The compressed gas powered gun of claim 4 wherein the valve assembly moves toward the barrel in response to slide impact and further aided by blow-back gas pressure, said forward valve assembly movement causing the other of said valves to open supplying the compressed gas from the source to expel the projectile.

6. The compressed gas powered gun of claim 4 wherein the means for sequentially aligning includes at least one projectile containing clip formed as a rigid open-ended hollow cylinder having an inside diameter substantially the same as the circular cross-section diameter of the projectile.

7. The compressed gas powered gun of claim 6 wherein the magazine receives, in a generally spiral pattern, a plurality of projectile containing clips with their respective cylindrical axes parallel, the magazine containing a generally constant force spring for urging projectile containing clips from the magazine.

8. The compressed gas powered gun of claim 7 wherein a number of the projectile containing clips are joined together.

9. The compressed gas powered gun of claim 7 further comprising a clip latch for holding a clip in alignment with the barrel against the urging of the constant force spring, the clip latch releasing in response to gas pressure as a projectile is propelled from its clip and along the barrel to allow the constant force spring to eject the clip and position a next projectile containing clip from the magazine into position in alignment with the barrel.

10. The compressed gas powered gun of claim 9 wherein the clip latch comprises a pivotable arm one end of which, when in a first position, engages a clip to hold that clip in alignment with the barrel, the arm pivoting to a second position releasing the clip in response to said gas pressure.

11. The compressed gas powered gun of claim 7 wherein the constant force spring comprises a coiled strip of generally flat spring material which moves along a spiral pattern within the magazine, unrolling as clips are introduced into the magazine.

12. The compressed gas powered gun of claim 6 wherein each projectile is generally spherical and sufficiently fragile so as to break upon impact with a target.

13. In a compressed gas powered projectile firing gun, an improved mechanism for releasing gas to propel a projectile along a gun barrel and from the gun comprising a shuttle valve movable between predetermined limits along a line generally collinear with the gun barrel, a spring biased striker for selectively impacting one shuttle valve end, a user actuable trigger mechanism for releasing the striker to move under the spring bias and impact the shuttle valve one end, a first valve near the shuttle valve one end opened by striker impact to release gas, a second valve near the shuttle valve end opposite said one end, the shuttle valve moving in response to striker impact and the released gas pressure toward one of the predetermined limits where the second valve opens releasing gas to propel the projectile.

14. A compressed gas powered marking gun for firing marking pellets each of which is generally spherical and sufficiently fragile so as to break upon impact with a target comprising:

a compressed gas source;

a projectile supply magazine containing a plurality of projectiles, the magazine receiving, in a generally spiral pattern, a plurality of projectile containing clips with their respective cylindrical axes parallel, the magazine containing a generally constant force spring for urging projectile containing clips from the magazine;

a barrel through which projectiles may be sequentially discharged;

means including a user actuable trigger for selectively supplying compressed gas from the source to expel a projectile through the barrel, and a selector mechanism movable between a first position where the trigger actuated supplying of gas is disabled, a second position where one actuation of the trigger supplies gas to expel a single projectile, and a third position where compressed gas is repeatedly periodically supplied; and means for sequentially aligning projectiles from the supply magazine with the barrel including at least one projectile containing clip received within the magazine and formed as a rigid open-ended hollow cylinder having an inside diameter substantially the same as the circular cross-section diameter of the projectile, and means actuated by compressed gas as it expels a projectile through the barrel for initiating clip movement to align another projectile with the barrel.

15. The compressed gas powered gun of claim 14 wherein a number of the projectile containing clips are joined together.

16. The compressed gas powered gun of claim 14 further comprising a clip latch for holding a clip in alignment with the barrel against the urging of the constant force spring, the clip latch releasing in response to gas pressure as a projectile is propelled from its clip and along the barrel to allow the constant force spring to eject the clip and position a next projectile containing clip from the magazine into position in alignment with the barrel.

17. The compressed gas powered gun of claim 16 wherein the clip latch comprises a pivotable arm one end of which, when in a first position, engages a clip to hold that clip in alignment with the barrel, the arm pivoting to a second position releasing the clip in response to said gas pressure.

18. The compressed gas powered gun of claim 17 wherein the arm has another end which, when the arm is in the second position, lies in the path of ejected clips, so that, when a clip is ejected, the clip strikes the arm returning the arm to the first position.

19. The compressed gas powered gun of claim 14 wherein the constant force spring comprises a coiled strip of generally flat spring material which moves along a spiral pattern within the magazine, unrolling as clips are introduced into the magazine.

20. A compressed gas powered gun for discharging projectiles and, upon the discharge of one projectile, to automatically position another projectile in a location within the gun to be subsequently discharged therefrom comprising:

a compressed gas source;

a projectile supply magazine containing a plurality of projectiles, each projectile having a generally circular cross-sectional configuration;

a barrel through which projectiles may be sequentially discharged;

means including a user actuable trigger for selectively supplying compressed gas from the source to expel a projectile through the barrel;

means for sequentially aligning projectiles from the supply magazine with the barrel including at least one projectile containing clip formed as a rigid open-ended hollow cylinder having an inside diameter substantially the same as the circular cross-section diameter of the projectile, the magazine receiving, in a generally spiral pattern, a plurality of projectile containing clips with their respective cylindrical axes parallel, the magazine containing a generally constant force spring for urging projectile containing clips from the magazine;

a clip latch for holding a clip in alignment with the barrel against the urging of the constant force spring, the clip latch releasing in response to gas pressure as a projectile is propelled from its clip and along the barrel to allow the constant force spring to eject the clip and position a next projectile containing clip from the magazine into position in alignment with the barrel, the clip latch comprising a pivotable arm one end of which, when in a first position, engages a clip to hold that clip in alignment with the barrel, the arm pivoting to a second position releasing the clip in response to said gas pressure, the arm having another end which, when the arm is in the second position, lies in the path of ejected clips, so that, when a clip is ejected, the clip strikes the arm returning the arm to the first position.

21. A compressed gas powered gun for discharging projectiles and, upon the discharge of one projectile, to automatically position another projectile in a location within the gun to be subsequently discharged therefrom comprising:

a compressed gas source;

a projectile supply magazine containing a plurality of projectiles, each projectile having a generally circular cross-sectional configuration;

a barrel through which projectiles may be sequentially discharged;

means including a user actuable trigger, a spring loaded slide which is released to move under spring urging upon user actuation of the trigger, and a valve assembly actuable by slide impact to release compressed gas thereby selectively supplying compressed gas from the source to expel a projectile through the barrel, the slide and valve assembly being axially aligned with the barrel;

means for sequentially aligning projectiles from the supply magazine with the barrel, the means for sequentially aligning including at least one projectile containing clip formed as a rigid open-ended hollow cylinder having an inside diameter substantially the same as the circular cross-section diameter of the projectile, the magazine receiving, in a generally spiral pattern, a plurality of projectile containing clips with their respective cylindrical axes parallel;

a generally constant force spring within the magazine for urging projectile containing clips from the magazine; and a clip latch for holding a clip in alignment with the barrel against the urging of the constant force spring, the clip latch releasing in response to gas pressure as a projectile is propelled from its clip and along the barrel to allow the constant force spring to eject the clip and position a next projectile containing clip from the magazine into position in alignment with the barrel, the clip latch comprising a pivotable arm one end of which, when in a first position, engages a clip to hold that clip in alignment with the barrel, the arm pivoting to a second position releasing the clip in response to said gas pressure, the arm having another end which, when the arm is in the second position, lies in the path of ejected clips, so that, when a clip is ejected, the clip strikes the arm returning the arm to the first position.

* * * * *